US006735994B2

(12) United States Patent
Bühler et al.

(10) Patent No.: US 6,735,994 B2
(45) Date of Patent: May 18, 2004

(54) FORGING OF WORKPIECES

(76) Inventors: Rainer Bühler, Brunnenstrasse 19, Wolfschlugen (DE); Noppadol Amorntatkul, 53 Sukhumvit 101/1, Soi, Prawitlehouan 14, Prakanong Bangkok 10260 (TH)

( * ) Notice: Subject to any disclaimer, the term of this patent is extended or adjusted under 35 U.S.C. 154(b) by 0 days.

(21) Appl. No.: 09/600,400

(22) PCT Filed: Jan. 14, 1999

(86) PCT No.: PCT/GB99/00119

§ 371 (c)(1),
(2), (4) Date: Jan. 2, 2002

(87) PCT Pub. No.: WO99/36207

PCT Pub. Date: Jul. 22, 1999

(65) Prior Publication Data

US 2003/0000274 A1 Jan. 2, 2003

(30) Foreign Application Priority Data

Jan. 15, 1998 (GB) ..... 9800861

(51) Int. Cl.[7] ..... B21J 5/08
(52) U.S. Cl. ..... 72/20.1; 72/318; 72/377
(58) Field of Search ..... 72/318, 357, 377, 72/20.1

(56) References Cited

U.S. PATENT DOCUMENTS 2,100,939 A * 11/1937 Brenner
2,278,293 A * 3/1942 Watson ..... 470/191
3,218,837 A * 11/1965 Wilson
4,425,779 A * 1/1984 Diemer et al. ..... 72/334
4,468,149 A * 8/1984 Kelly et al. ..... 403/316
4,704,053 A * 11/1987 Hipkins et al. ..... 405/259.1
5,655,349 A * 8/1997 Ghali et al. ..... 52/334
5,660,594 A * 8/1997 Viljakainen ..... 470/10
5,664,902 A * 9/1997 Holdsworth ..... 403/265
5,799,528 A * 9/1998 Camping ..... 72/318
5,895,324 A * 4/1999 Inada ..... 470/711
6,099,196 A * 8/2000 Lancelot, III ..... 403/300
6,202,282 B1 * 3/2001 Holdsworth ..... 29/456
6,286,270 B1 * 9/2001 Gruson et al. ..... 52/155

FOREIGN PATENT DOCUMENTS

DE 197 19 578 A1 * 1/1998
FR 2 653 809 * 5/1991
GB 2 286 782 A * 8/1995

OTHER PUBLICATIONS

Patent Abstracts of Japan, publication No. 05098741, published Apr. 20, 1993, Takakimi, "Manufacture of Fixing Section in Reinforcement".*

* cited by examiner

*Primary Examiner*—Daniel C. Crane
(74) *Attorney, Agent, or Firm*—Lowe Hauptman Gilman & Berner LLP

(57) ABSTRACT

The invention relates to apparatus for enlarging part of a metal workpiece by cold forging, characterised by an enlarging die (5, 6) and by the die having means (8, 8') to alleviate stress to the workpiece during forging.

20 Claims, 4 Drawing Sheets

FORGING OF WORKPIECES

The invention relates to forging of workpieces, particularly metal workpieces such as reinforcing bars for use in building construction, particularly concrete construction.

Concrete reinforcing bars, which may be deformed by external ribs, or plain, are usually provided in finite lengths.

It is often necessary to join them in line to provide a more extensive reinforcement than might otherwise be possible owing to the finite length. Such bars have a high tensile strength, and it is accordingly necessary not to undermine that strength during any process to enable the bar to be connected with another. Usually this is effected by providing a thread on one end, usually by cold working, which can be advantageous as the bars are usually made from steel with a high carbon and manganese content. However, forming a thread at one end of the bar often reduces the cross-section of the bar, thus lowering its tensile cross-section in the region of the thread, which leads to failure in use, which can be catastrophic for the concrete. It is thus necessary to ensure that the threaded end (which is formed by rolling, milling or cutting) is enlarged, relative to the remaining length of the bar, so that the effective tension cross-section of the threaded part is not smaller than that of the remaining length of bar. However, in the past, enlarging techniques have not been able satisfactorily to produce an enlarged end of a ribbed bar in which the tensile strength is not effected as compared with that of the remainder of the bar.

It is an object of the invention to seek to mitigate these disadvantages.

According to a first aspect of the invention there is provided apparatus for cold forging a metal workpiece, comprising a die with means to alleviate stress to the workpiece during forging.

According to a second aspect of the invention there is provided apparatus for enlarging part of a metal workpiece by cold forging, comprising an enlarging die with means to alleviate stress to the workpiece during forging.

Using the invention it is possible to provide an enlarged end of deformed (ribbed) and undeformed reinforcement bars without changing their overall tensile characteristics.

The stress alleviating means may comprise a relief channel into which metal can flow during forging. This is a relatively simple yet effective construction, particularly where the relief channel may be a substantially U-shaped groove in the die.

There may be two opposed dies. This provides for positive enlargement over the whole circumference of the workpiece.

Each die may have a first die part and a second die part which second die part may be enlarged relative to the first die part and may be adapted to allow part of the workpiece to project therefrom, the arrangement being such that in use the projecting part of the workpiece is upset and enlarged. This is a particularly simple and efficient construction.

There may be means to press the die parts together, and means to apply pressure in a direction substantially at 90° to the first-mentioned press direction. This provides for maintaining a tensile integrity of the workpiece during a forging/enlarging procedure.

The means for pressing the die parts together may comprise an hydraulic press acting substantially vertically in use. This is an effective construction.

The second-mentioned means may comprise an hydraulic press acting substantially horizontally. This is also an effective construction.

At least the distance between the enlarging die and the substantially-horizontally acting hydraulic press may be adjustable. This provides for a desired enlarging operation.

The distance may be adjustable by adjusting the pressure of a forging piston for effecting forging. This is an effective way of adjusting the operation.

An equally effective alternative may be by the distance being adjustable by adjustment of a forging pad on which the forging piston can act.

The pressure of the substantially vertically acting hydraulic press may also be adjustable. This again provides a desired control of the procedure.

The first die part may have an internal die configuration substantially complementary to the external configuration of a major part of a workpiece which is to be forged. This provides for support of the workpiece during enlargement.

According to a third aspect of the invention there is provided a method of cold forging an elongate metal workpiece, comprising the steps of providing forging apparatus having a die, providing the die with means to alleviate stress in the workpiece during forging, and forging the workpiece.

The method may include the steps of providing two opposed forging dies. This provides a positive method of operation.

Each forging die may comprise a relief channel into which material of the workpiece can flow during forging. This provides that the tensile integrity of the workpiece is maintained.

There may be the steps of providing that each die part has a first die part and a second die part enlarged with respect to the first die part, inserting an elongate workpiece between the dies so that the first die part receives a main part of the workpiece, and an end of the workpiece projects through and beyond the second die part, and upsetting the projecting end so that it flows into the enlarged second die part. This provides an efficient method of enlargement.

There may be the steps of removing the forged workpiece from the apparatus and forming a thread on the enlarged part of the workpiece. This provides a way to connect the workpiece with another similar one.

According to a fourth aspect of the invention there is provided an elongate metal workpiece whenever forged by a method as hereinbefore defined, or whenever produced by a method as hereinbefore defined.

The elongate metal workpiece may have at least one threaded end, and may comprise a reinforcing bar for use in building construction.

Such a reinforcing bar may have an internally threaded sleeve on an end opposite an enlarged threaded end.

According to a fifth aspect of the invention there is provided a reinforcing system, comprising a plurality of reinforcing bars as hereinbefore defined.

According to a sixth aspect of the invention there is provided concrete whenever reinforced by a workpiece or reinforcing bar as hereinbefore defined.

Apparatus and a method for cold forging or enlarging a metal workpiece by cold forging is hereinafter described, by way of example, with reference to the accompanying drawings.

Figure 1:
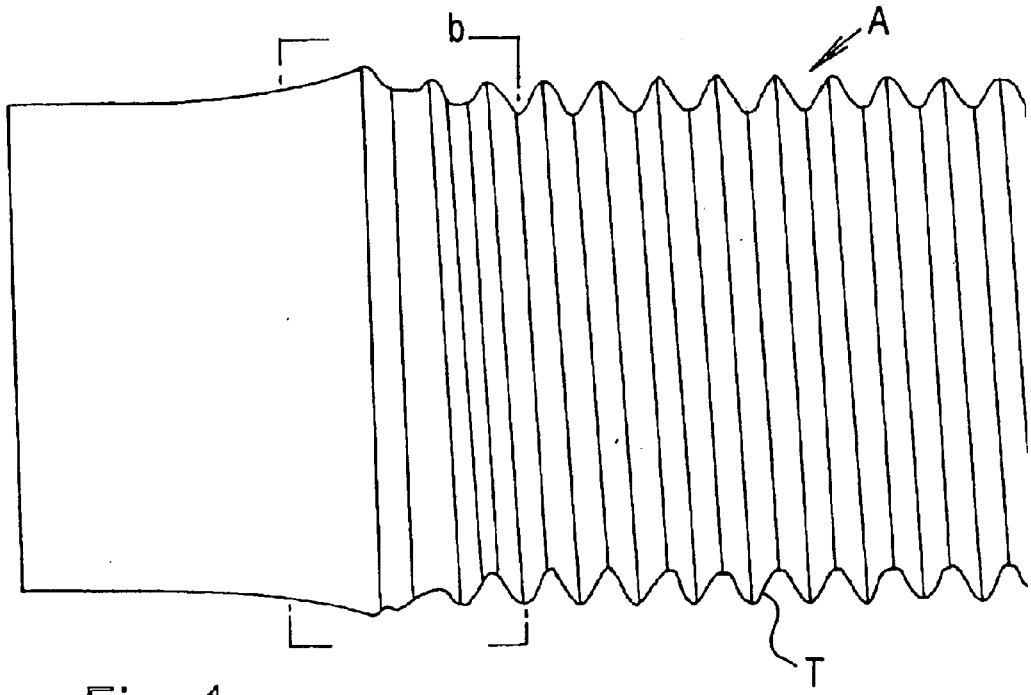
Fig. 1 (PRIOR ART)
FIG. 1 shows the threaded end of a prior art deformed metal reinforcing bar for use in reinforcing concrete in building construction.

Referring to the drawings, there is shown apparatus 1 (FIGS. 4 to 8) for cold forging or enlarging a metal workpiece in the form of a reinforcing bar or rebar 2 for concrete comprising a die 3 to alleviate stress to the workpiece 2 during forging.

Figure 2:
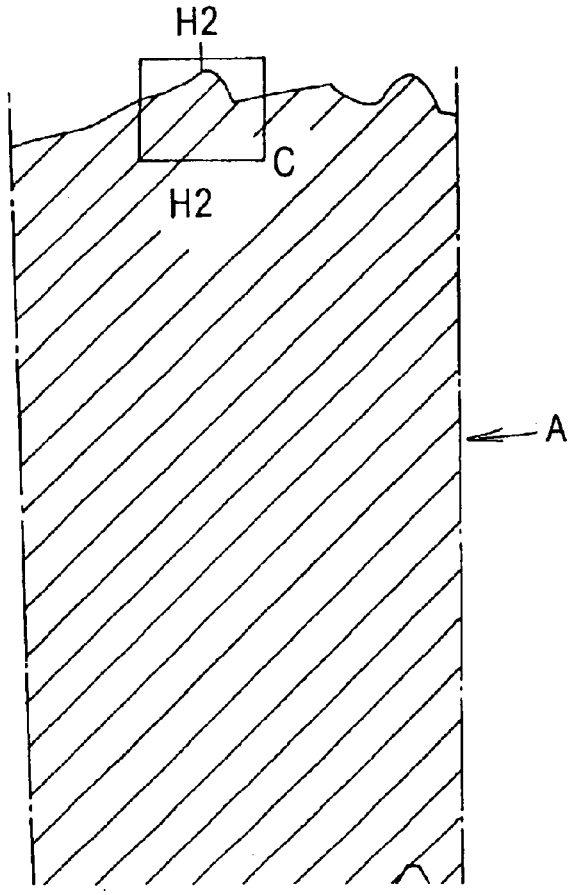
Fig. 2 (PRIOR ART)
FIG. 2 shows a cross-section at 'b' in FIG. 1.
Figure 3:
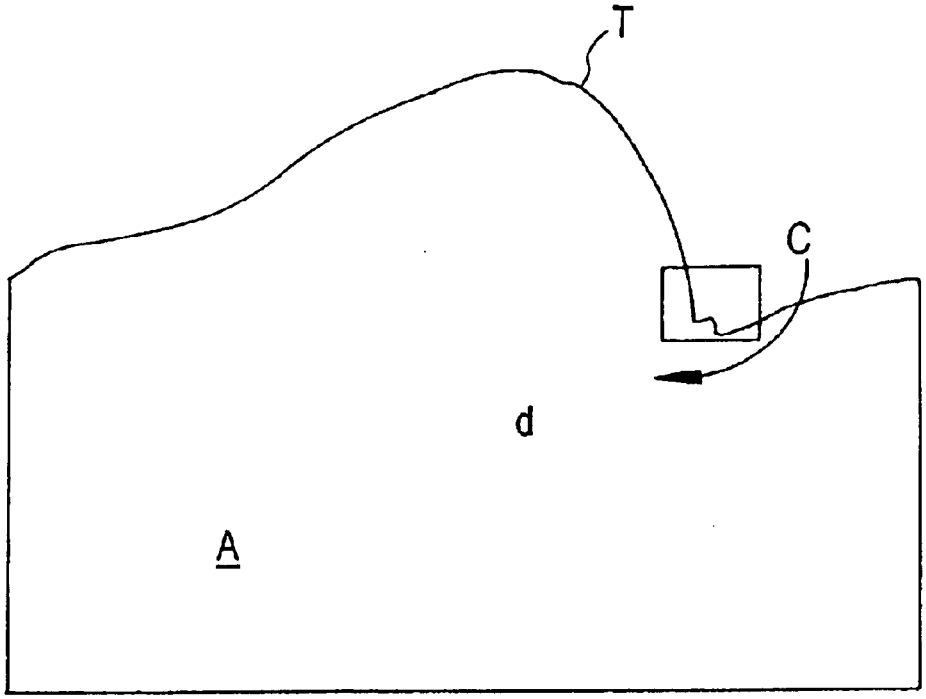
FIG. 3 shows an enlargement of C in FIG. 2, at a magnification of 20:1.

Thus a reinforcing bar 2 with a very high tensile strength which has a variable outer configuration owing to the variation in the size and shape of surface deformations (ribs), particularly longitudinally extending ones 4 can be soft cold enlarged without reducing the mechanical characteristics and strength of the reinforcing bar 2. Thus the tensile strength and yield strength of the reinforcing bars are not reduced, unlike in the prior art of FIGS. 1 to 3. FIG. 1 shows an end of a prior art reinforcing bar A which has been enlarged and then had a thread 'T' applied to it. There is a tendency for a crack 'C' to form, FIGS. 2, 3, if the enlarging process is not controlled so that the enlargement is either too large or conversely too small. In this latter case, the failure occurs at the threaded section as the cross-sectional area of the thread is too small. Such dimensional irregularities will lead to early failure in use of the prior art rebar A.

This is obviated using the apparatus 1 of FIGS. 4 to 8, in which there is the die 3 in the form of a pair of substantially vertically (as viewed) opposed dies 5, 6, each having a guide channel or track 7 for longitudinal ribs 4 of the rebar 2, each die also having a relief stress alleviating means in the form of a substantially U-shaped groove 8' which extends from a second die part 8 or enlarging die which is enlarged with respect to a first die part 9. There is also a tapered transition or contour 10 between the first and second die parts 9, 8 which allows a controlled application of pressure.

The first die part 9 is complementary to the outer diameter of the main body part of the reinforcing bar 2. The length of the dies 5, 6 is such that the reinforcing bar 2 at one end extends through and beyond the enlarged die part 8. The apparatus 1 includes a first pressure applying means in the form of an hydraulic press 11 which acts substantially vertically (as viewed) to act on the main part of the reinforcing bar by pressing on the ribs 4. This reduces the risk of increasing stress in the reinforcing bar 2 during enlargement of the end. There is also a second pressure applying means in the form of an hydraulic press 12 which acts substantially horizontally (as viewed). The horizontal distance can be adjusted as desired by adjusting the distance of the piston 13 and/or by adjusting a pad or disc 14 which pad or disc 14 is intermediate the piston 13 and the enlarged die part 8. The effect is to adjust the distance of the reinforcing bar which projects beyond the enlarged die part 8. Other means of adjustment may be utilised.

In operation to form an enlarged end 2*a* of the reinforcing bar 2, the dies 5, 6 are separated vertically, the reinforcing bar 2 is inserted through a guide and support 15 in a frame 16 of the apparatus 1, so that the end to be enlarged projects beyond the enlarged die parts 8. The bar 2 is then gripped by lowering the die part 5 vertically, arrow 'X' via its piston 17 to engage the lower die part so that the bar 2 is supported over substantially the whole length of its main body. Then the hydraulic press 12 is actuated to act on the projecting end to upset it in a cold forging operation, the relief groove 8' allowing the upsetting to take place without the imposition of additional stresses during enlargement. Also, the groove 8' allows the shape and dimensions to be controlled in a positive manner which control is assisted by the tapered zone 10, which with the relief groove 8' allows a smooth, controlled enlargement with alleviation of stress build up, so that the bar has a tapered part 17 between the main body and the enlarged end 2*a* with no additional stresses.

After enlargement of one end, the other end can be enlarged too, or not. The enlarged end(s) is/are then threaded by rolling, milling or broaching to form a thread 18. As the enlarging operation is effected cold, with no increase in stress, the material of the enlarged end is "soft", so facilitating a rapid thread-cutting operation without damage to the thread cutting tools. The provision of soft cold forging allows for stress relieving so that there is no increase in stress in the enlarged end, and the control of the distance of the projecting reinforcing bar beyond the enlarging dies 8 provides the desired proper size of the end being enlarged. Thus the enlarged end is not too large (which would create a crack in the enlarged end), and not too small (which would create failure in the thread region), according to the particular size and shape of the reinforcing bar being enlarged.

Figure 12:
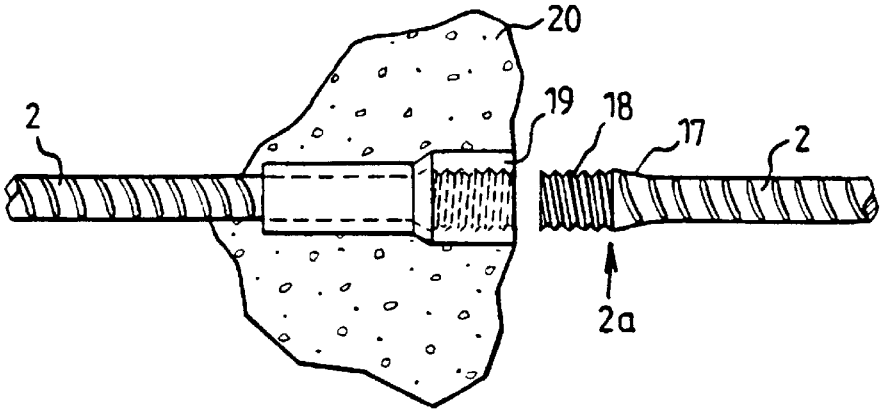
FIG. 12 shows use of a reinforcing bar according to the invention.
Figure 13:
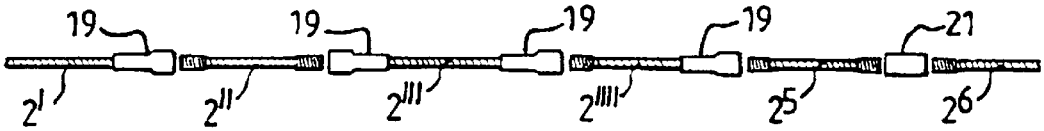
FIG. 13 shows a reinforcement system comprising a plurality of reinforcing bars according to the invention.

FIG. 12 shows a reinforcing bar 2 with an internally threaded sleeve 19 on one end in concrete 20 about to be connected with a reinforcing bar 2 according to the invention, the threaded enlarged end 2*a*, 18 being screwed into the sleeve 19 to effect connection. This can be effected manually on site, with the aid if required of pliers or tongs. FIG. 13 shows a reinforcement for concrete in the form of a complete system of reinforcing bars connected together—looking from the left there is a bar 2' with a sleeve 19 (like that of FIG. 12) a bar 2" with enlarged threaded ends, a bar 2''' with a threaded sleeve 19 at each end, a bar 2'''' with a threaded enlargement at one end and an internally threaded sleeve 19 at the other, a bar $\mathbf{2}^5$ with a double external enlarged thread at each end, a sleeve 21 with internal threads at both ends and a bar $\mathbf{2}^6$ with an enlarged threaded end. These, it will be understood, are examples of possible combinations for connecting reinforcing bars embodying the invention in a reinforcement system for concrete.

Figure 4:
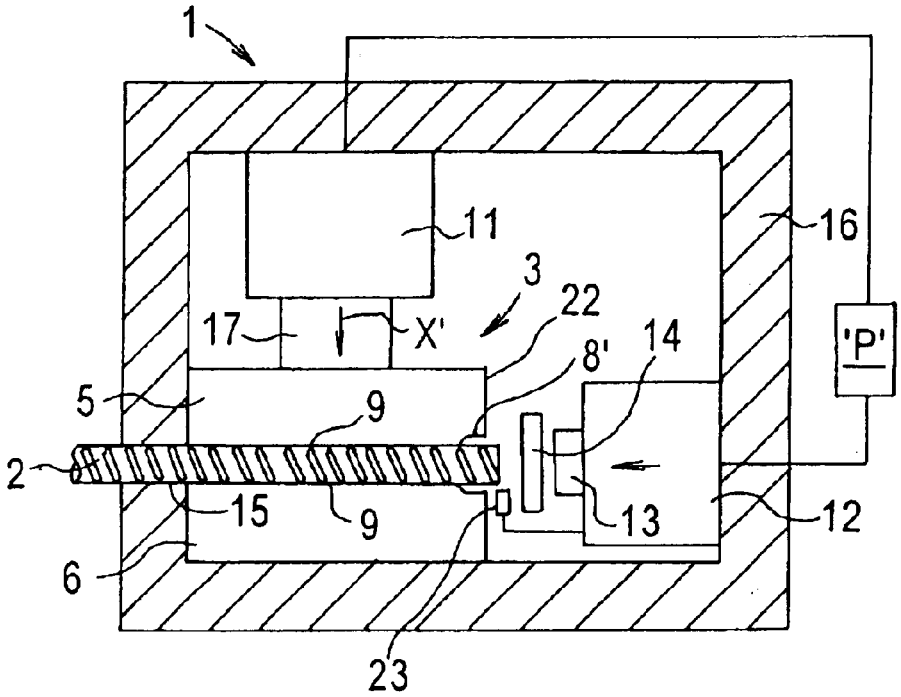
FIGS. 4 and 5 show respectively schematic elevational views of apparatus according to the invention for soft-cold forging/enlarging of a metal reinforcing bar.
Figure 5:
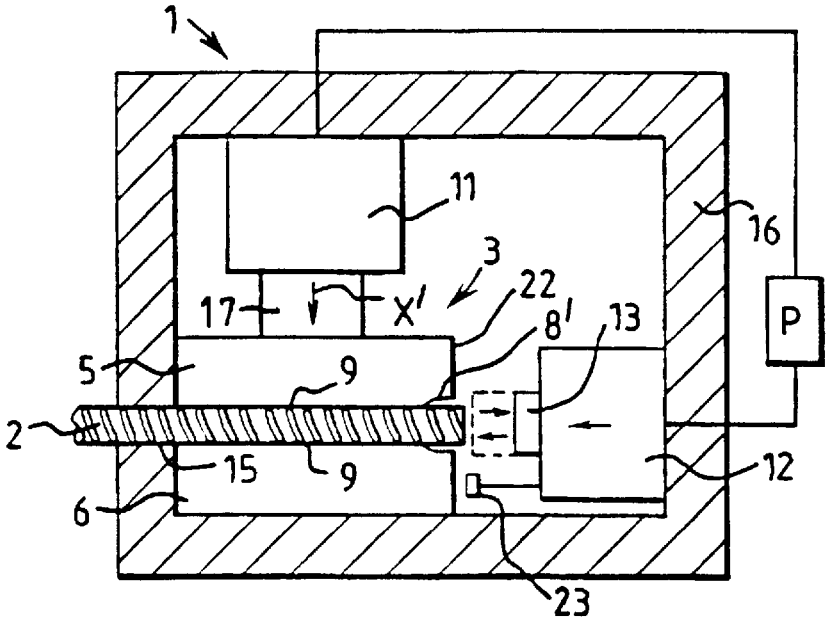
Figure 6:
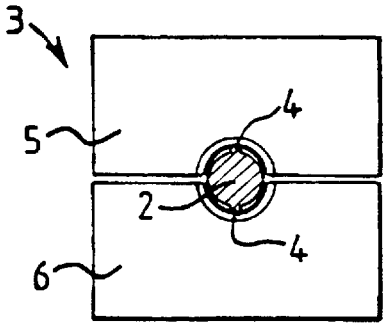
FIGS. 6 and 7 show an end elevational view of forging dies used in the apparatus of FIGS. 4 and 5, FIG. 6 showing a reinforcing bar in position.
Figure 7:
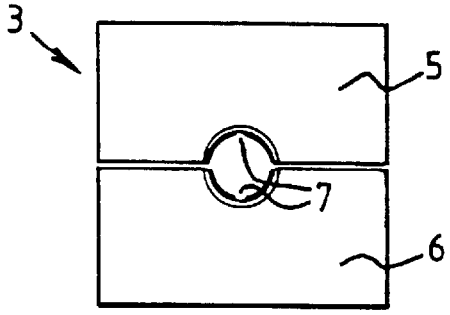
Figure 8:
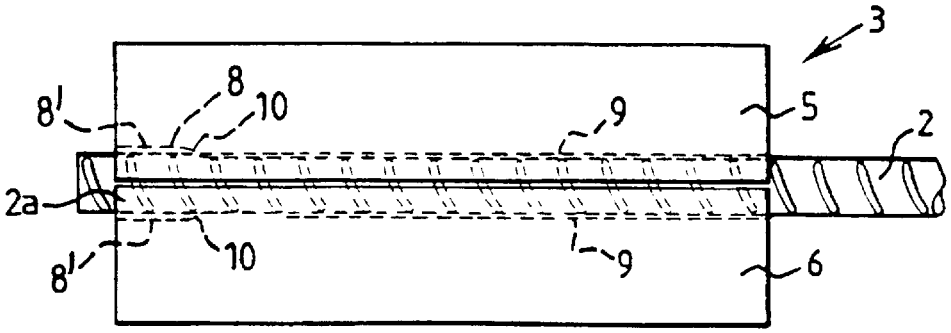
FIG. 8 shows a side elevational view of the forging dies of FIG. 6 with the reinforcing bar in position for enlargement of one end.
Figure 9:
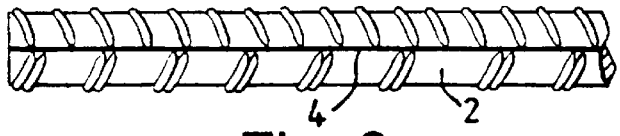
FIGS. 9 to 11 show stages in the production of an enlarged threaded end of a reinforcing bar according to the invention.
Figure 10:
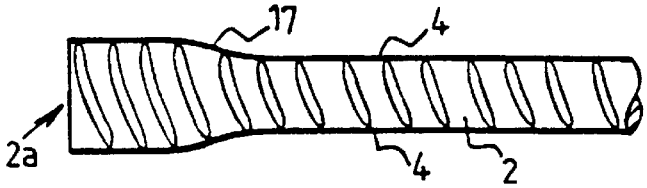
Figure 11:
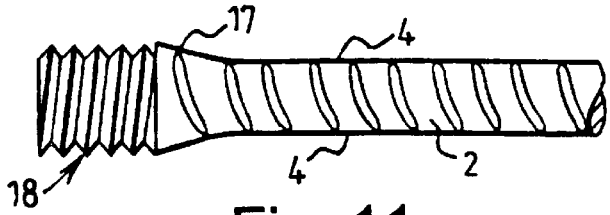

It will be understood that the operation of the dies 5, 6 and of the press 12 is under the control of a power pack unit 'P' as shown in FIGS. 4, and 5 which is a numerically controlled unit.

Thus the timing of the pressing operation, and the pressure thereof can be controlled automatically. Thus the same pressure can be used for rebars of varying diameter e.g. 120 bar or 180 bar pressure may be used, the apparatus 1 acting to upset the end of the rebar 2 being cold-forged, whatever its diameter. This is achieved by a sensor 23 which may be a mechanical trip switch, or other means such as a laser or other optical device which is placed adjacent the face 22 of the dies 5, 6 facing the press 12 and which senses the approach of the piston 13 and pad 14 and actuates the press 12 to cease action and return to a start position just before the piston 13/pad 14 contacts the facing face 22 of the dies 5, 6. On ceasing application of the pressure, nevertheless the material of the rebar continues to flow to finish finally forming the upset end. Thus the sensor 23 acts to ensure that there is no need to adjust the force applied whatever the diameter of the rebar being cold forged. The pressure on the die faces 22 would be about 340 bar if there was contact with the piston 13/pad 14. With the sensor, the pressure is only 120–180 bar, which therefore saves the dies 5, 6 from damage, time is saved as no re-setting of pressure is required, power is saved, there is less general wear and tear on the apparatus, and on personnel operating same.

Also, before a forging operation, the start position (to the right in FIGS. 4, 5) of the pad 13 is set to define the length of the rebar 2 projecting to the right as viewed, beyond surfaces 22. This thus provides a simple way of inserting the rebar in the apparatus so that it abuts the piston 13/pad 14 prior to forging.

In a general procedure, a user of rebars 2 of a particular length which are too short and requiring to be lengthened are sent to the applicant, who forges and threads one end, and usually adds a sleeve to the opposite end, and the modified rebar is then sent back to the customer, for use as shown in FIG. 12.

It will be understood too that the apparatus 1 described with reference to the drawings provides a regular and homogenous enlarged end 2*a* in which the stresses are virtually identical to those in the unenlarged part of the bar so that a full load can be applied when used in concrete constructions. Moreover, cold enlarging as described herein with reference to the drawings is also advantageous in that it can be carried out at a desired location, e.g. a construction or job site, as the apparatus can be mobile. Also, cold enlarging is less expensive than hot enlarging as no heating energy is required, and no additional time need be allowed for heating up and cooling down of a workpiece.

What is claimed is:

1. Apparatus for cold forging of metal workpiece of varying diameter, said apparatus comprising:

(i) two opposed dies;

(ii) each said die having a first die part and a second die part;

(iii) said second die part being enlarged relative to the first die part, whereby to form stress alleviating means for alleviating stress to the workpiece during cold forging;

(iv) a pressure applying means;

(v) the second die part being adapted to allow part of the workpiece to project therefrom, whereby said projecting part of the workpiece is upset by the pressure applying means and enlarged during cold forging;

(vi) adjusting means for adjusting the distance of said projecting part of the workpiece beyond said second die part;

(vii) means for providing for a uniform forging pressure by the pressure applying means for varying diameters of workpiece during forging; and (viii) control means for automatic control of said pressure, said control means including a sensor acting to ensure that there is no need to adjust the pressure applied whatever the diameter of the workpiece.

2. Apparatus as defined in claim 1, wherein said sensor is adjacent a face of the dies from which the workpiece projects.

3. Apparatus as defined in claim 2, wherein said opposed dies define a face and wherein said sensor is adjacent said face.

4. Apparatus as defined in claim 2, further comprising pressing means for pressing the die parts together in a pressing direction, and the pressure applying means applies pressure in a direction substantially at 90° to said pressing direction.

5. Apparatus as defined in claim 4, wherein the pressing means comprise an hydraulic press acting substantially vertically.

6. Apparatus as defined in claim 4, wherein the pressure applying means comprise an hydraulic press acting substantially horizontally.

7. Apparatus as defined in claim 6, wherein at least the distance between the dies and the substantially horizontally acting hydraulic press is directly adjustable.

8. Apparatus as defined in claim 6, wherein at least the distance (v) between the dies and the substantially-horizontally acting hydraulic press is indirectly adjustable.

9. Apparatus as defined in claim 6, wherein the distance (v) between dies and the substantially-horizontally acting hydraulic press is adjustable by adjusting a forging piston for effecting forging.

10. Apparatus as defined in claim 6, wherein the distance between the dies and the substantially-horizontally acting hydraulic press is adjustable by adjustment of a forging pad on which a forging piston can act.

11. Apparatus as defined in claims 5, wherein the pressure of the substantially vertically acting hydraulic press is adjustable.

12. Apparatus as defined in claim 1, wherein the enlarged die part comprises a substantially U-shaped groove therein.

13. Apparatus as defined in claim 1, wherein the first die part has an internal die configuration substantially complementary to the external configuration of a major part of a workpiece which is to be forged.

14. A method of cold forging elongate metal workpieces of varying diameter, the method comprising the steps of:

(i) providing two opposed dies;

(ii) providing each die with a first die part and with a second die part which is enlarged with respect to the first die part to form stress alleviating means for alleviating stress to the workpiece during cold forging;

(iii) inserting an elongate workpiece between the dies so that the first die part receives a main part of the workpiece and part of the workpiece projects through and beyond the second die part;

(iv) upsetting the projecting part, with a uniform forging pressure regardless of the diameter of the workpiece, so that the projecting part flows into the enlarged second die part;

(v) providing that the distance of the projecting part of the workpiece beyond the second die part is adjustable; and (vi) providing control means for automatic control of said pressure whereby there is no need to adjust the pressure applied whatever the diameter of the workpiece.

15. A method as defined in claim 14, further comprising the step of providing in each die a relief channel for receiving a rib of the workpiece.

16. A method as defined in claim 14, further comprising the step of forming a thread on the enlarged part of the workpiece.

17. A method as defined in claim 14, further comprising the step of adjusting the distance of the projecting part of the workpiece beyond the second die part.

18. A method of cold forging elongate metal workpieces of varying diameter, the method comprising the steps of:

(i) providing two opposed dies;

(ii) providing each die with a first die part and with a second die part which is enlarged with respect to the first die part to form stress alleviating means for alleviating stress to the workpiece during cold forging;

(iii) inserting an elongate workpiece between the dies so that the first die part receives a main part of the workpiece and part of the workpiece projects through and beyond the second die part;

(iv) providing a pressing piston facing a face of the opposed dies from which face the workpiece projects;

(v) upsetting the projecting part, with a forging pressure applied from said press to said projecting part, by the pressing piston so that the projecting part flows into the enlarged second die part; and (vi) ceasing application of the forging pressure when a spacing between the press and said face reaches a predetermined distance.

19. The method of claim 18, wherein step (vi) is performed without allowing the press and said face to physically contact, while allowing upsetting of the projecting part to continue.

20. The method of claim 18, further comprising the steps of providing a sensor between said face and said press, said sensor being adjacent to said face and defining said predetermined distance; and actuating said ceasing by said sensor when the spacing between the press and said face has reached said predetermined distance.

* * * * *

US006735994C1

(12) EX PARTE REEXAMINATION CERTIFICATE (7449th)

United States Patent

Bühler et al.

(10) Number: US 6,735,994 C1

(45) Certificate Issued: Apr. 6, 2010

(54) FORGING OF WORKPIECES

(76) Inventors: Rainer Bühler, Brunnenstrasse 19, Wolfschlugen (DE); Noppadol Amorntatkul, 53 Sukhumvit 101/1, Soi Prawitlehouan 14, Prakanong Bangkok 10260 (TH)

Reexamination Request:
No. 90/008,107, Jun. 5, 2006

Reexamination Certificate for:

| | |
|---|---|
| Patent No.: | **6,735,994** |
| Issued: | **May 18, 2004** |
| Appl. No.: | **09/600,400** |
| Filed: | **Jan. 2, 2001** |

(22) PCT Filed: Jan. 14, 1999

(86) PCT No.: PCT/GB99/00119

§ 371 (c)(1), (2), (4) Date: Jan. 2, 2002

(87) PCT Pub. No.: WO99/36207

PCT Pub. Date: Jul. 22, 1999

(30) Foreign Application Priority Data

Jan. 15, 1998 (GB) ..... 9800861

(51) Int. Cl.
*B21J 5/08* (2006.01)

(52) U.S. Cl. ..... 72/20.1; 72/318; 72/377

(58) Field of Classification Search ..... 72/20.1, 72/318, 377

See application file for complete search history.

(56) References Cited

U.S. PATENT DOCUMENTS

| | | | | | |
|---|---|---|---|---|---|
| 2,100,939 | A | * | 11/1937 | Brenner | 72/318 |
| 3,218,837 | A | * | 11/1965 | Wilson | 72/317 |
| 5,158,527 | A | * | 10/1992 | Bernard | 403/305 |
| 5,799,528 | A | * | 9/1998 | Camping | 72/318 |

FOREIGN PATENT DOCUMENTS

| | | | |
|---|---|---|---|
| AU | 52841 | * | 9/1974 |
| FR | 2653809 A1 | * | 5/1991 |

* cited by examiner

*Primary Examiner*—Jimmy G Foster

(57) ABSTRACT

The invention relates to apparatus for enlarging part of a metal workpiece by cold forging, characterised by an enlarging die (5, 6) and by the die having means (8, 8') to alleviate stress to the workpiece during forging.

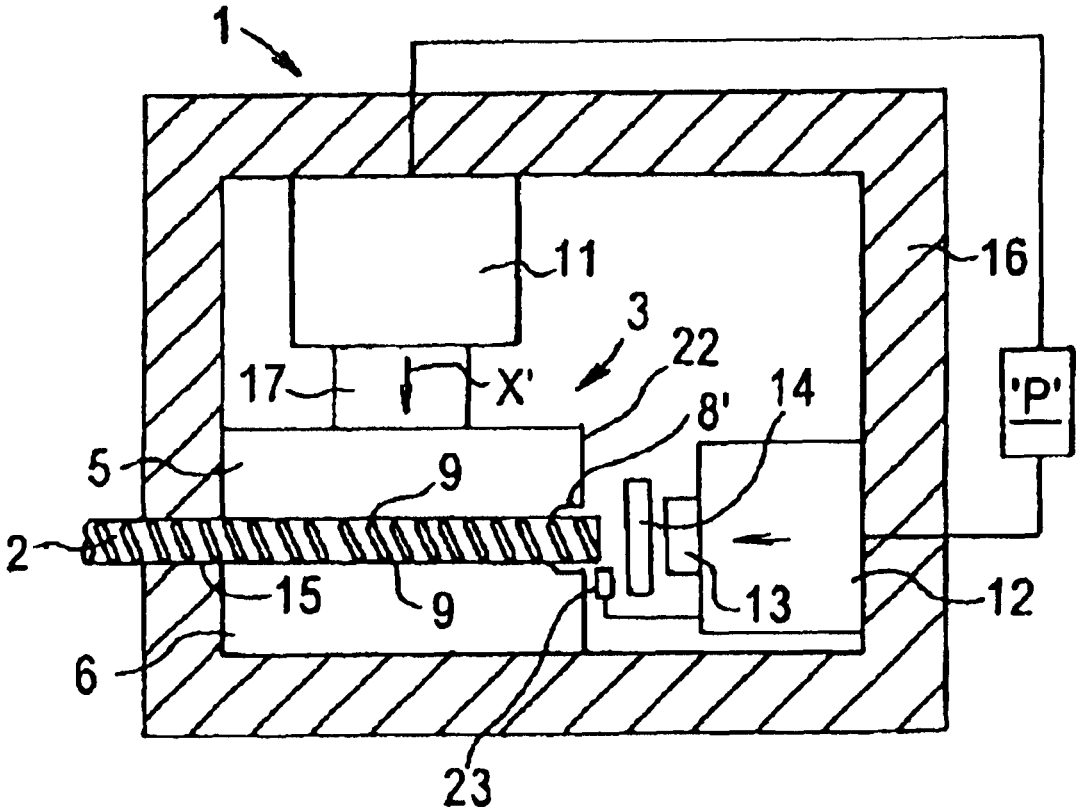

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–20 are cancelled.

* * * * *